United States Patent [19]

Hughes et al.

[11] 4,042,137

[45] Aug. 16, 1977

[54] MUNICIPAL REFUSE COLLECTION SYSTEM

[76] Inventors: Thomas Philip Hughes, 803 Quail Court, Roanoke Rapids, N.C. 27870; Clark Alexander Sherrill, 2811 Bleeker Square, Apt. H, Winston-Salem, N.C. 27106

[21] Appl. No.: 674,871

[22] Filed: Apr. 8, 1976

[51] Int. Cl.[2] ..... B65F 3/02

[52] U.S. Cl. ..... 214/302; 214/314

[58] Field of Search ..... 294/90, 88, 93, 94; 214/302, 303, 312, 314, 313, 147 G, 145 A

[56] References Cited

U.S. PATENT DOCUMENTS

| | | | |
|---|---|---|---|
| 3,804,277 | 4/1974 | Brown et al. | 214/302 |
| 3,894,642 | 7/1975 | Shive | 214/302 |

FOREIGN PATENT DOCUMENTS

| | | | |
|---|---|---|---|
| 106,518 | 4/1965 | Norway | 214/145 A |

*Primary Examiner*—Lawrence J. Oresky
*Attorney, Agent, or Firm*—B. B. Olive

[57] ABSTRACT

A system for roadside collection of municipal refuse includes a rotatable lift platform mounted on a refuse sink and which is adapted to invert a portable household refuse container to dump its contents. The container has a pair of horizontal locking bars on one face. The upper bar fits into a fixed hook on the rotatable platform. The lower bar is positively locked to the frame by means of a hydraulic piston which moves a lower hook into locking position upon the initiation of the frame rotation and moves such hook out of the locking position upon completion of the dumping operation.

8 Claims, 6 Drawing Figures

MUNICIPAL REFUSE COLLECTION SYSTEM

BACKGROUND OF THE INVENTION

1. Field of the Invention

The invention relates to portable refuse containers and means for dumping the contents of such containers. In particular, the invention relates to dumping mechanisms adapted to be mounted on a garbage truck and useful for inverting the refuse container and dumping its contents into the truck receptacle.

2. Description of the Prior Art

The prior art discloses a number of systems for automatically emptying household size refuse containers into larger refuse vessels, such as garbage trucks.

The closest known system is described in U.S. Pat. No. 3,738,516. This patent system includes a "low profile," portable plastic refuse container having a metal frame outer structure which forms two handles and a base support and mounts a pair of wheels. The metal frame also forms a pair of vertically spaced locking bars on a front surface of the container. The garbage truck is provided with a vertically swingable frame at the base of an opening in the truck wall. The frame has a pair of non-moving hooks which receive the container locking bars for lifting the container and dumping its contents. When the frame is in its normally lowered retracted position, only the upper hook and locking bar are engaged. Midway through the rotation and inversion, the container slides down a small distance so that the other hook and locking bar engage. Thus, only one hook is supporting the container at any given time. This system has the principal disadvantage of not positively locking the container to the frame during the dumping operation.

Two variations of another prior art system are described in U.S. Pat. Nos. 3,804,277 and 3,894,642. This system is manufactured by Rubbermaid Industrial Products Corporation of Statesville, N.C. Both variations of this system incorporate a portable waste container having on one side a lower cross bar and an upper downwardly opening recess. The truck-mounted dumping mechanism has an upper saddle which engages the recess and a lower downwardly directed, pivotal hook for engaging the cross bar. In one variation, the frame mounts a cam-operated linkage and in the other variation a lift arm which pivots the lower hook over and behind the lower cross bar in response to the rotation of the frame to invert the receptacle.

Other similar systems are the "Roll-A-Waste" system manufactured by the Molded Plastics Products Division of United States Steel, Pittsburgh, Pa., and the "Peli-Can" system manufactured by P. P. I. Industries, Inc., of Elk Grove Village, Ill. A summary of all four of the above systems may be found in the September/October 1975 "Refuse Report" published by the International City Management Association.

SUMMARY OF THE INVENTION

According to the apparatus of the present invention, the contents of a portable household refuse container may be automatically dumped into a garbage truck or other refuse sink. The container includes a pair of vertically-spaced locking bars on one side of the container. A dumping mechanism adapted to engage the bars is fixed adjacent an opening in the refuse sink. The dumping mechanism includes a vertical support frame fixed to the refuse sink and a rotatable lift platform which is adapted to swing vertically about a fixed horizontal axis on the support frame. The vertical swinging is achieved by a motor-driven lift arm which rides in a track on the lift platform. The container is initially mounted on the lift platform outer surface by placing the upper locking bar in a fixed support hook. After the platform has swung to a position where the container wheels are slightly off the ground, a piston-mounted lower support hook positively locks over the lower bar to lock the container to the platform. The platform is then rotated until the container is completely inverted in a dumping position. By reversing the motor, the platform is lowered so that the container wheels again contact the ground with the piston-mounted hook disengaging just before the wheels touch the ground.

DESCRIPTION OF THE PREFERRED EMBODIMENT

Figure 5:
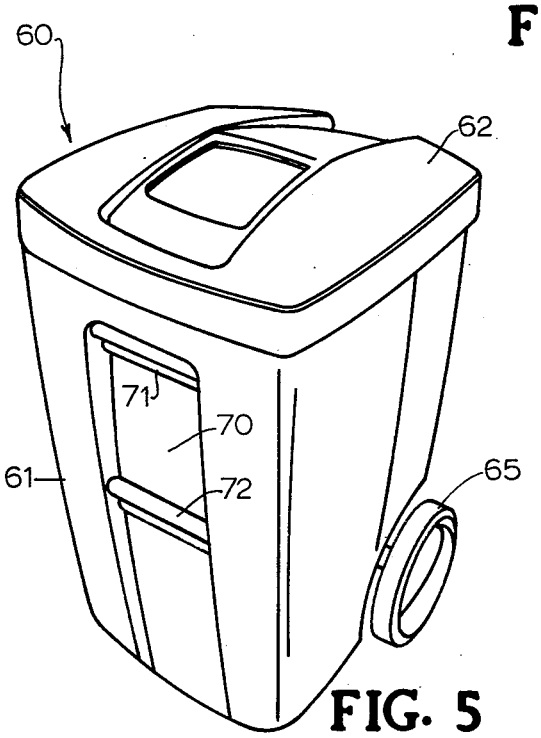
FIG. 5 is a front perspective view of the refuse container.
Figure 6:
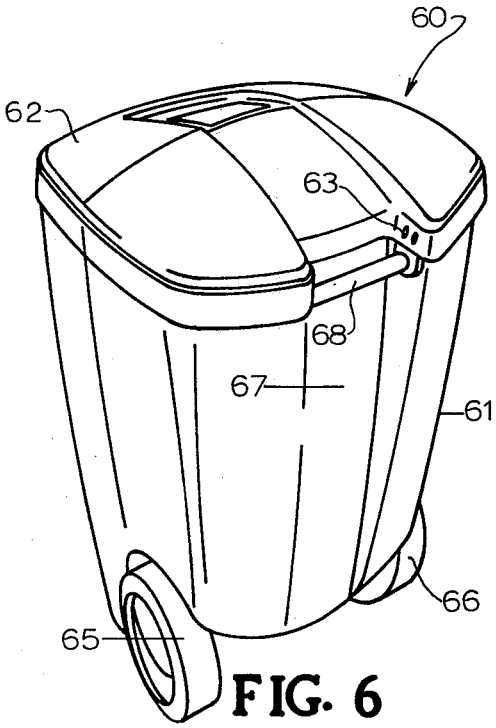
FIG. 6 is a rear perspective view of the refuse container.

Illustrated in FIGS. 5 and 6 is a household refuse container 60 adapted for use with the dumping mechanism of the invention. Container 60 is preferably molded from plastic and has a capacity of approximately 80 gallons. Container 60 includes a receptacle portion 61 and a top 62 which is hingedly secured to the receptacle portion by hinges 63 located at the rear of container 60. A pair of wheels 65, 66 support container 60. A rear vertical recess 67 includes a handle 68 which the operator may use for rolling container 60 from one site to another. The front of container 60 includes a recess 70 having a pair of horizontal locking bars 71, 72 which are adapted to being engaged by the dumping mechanism as described below.

Figure 1:
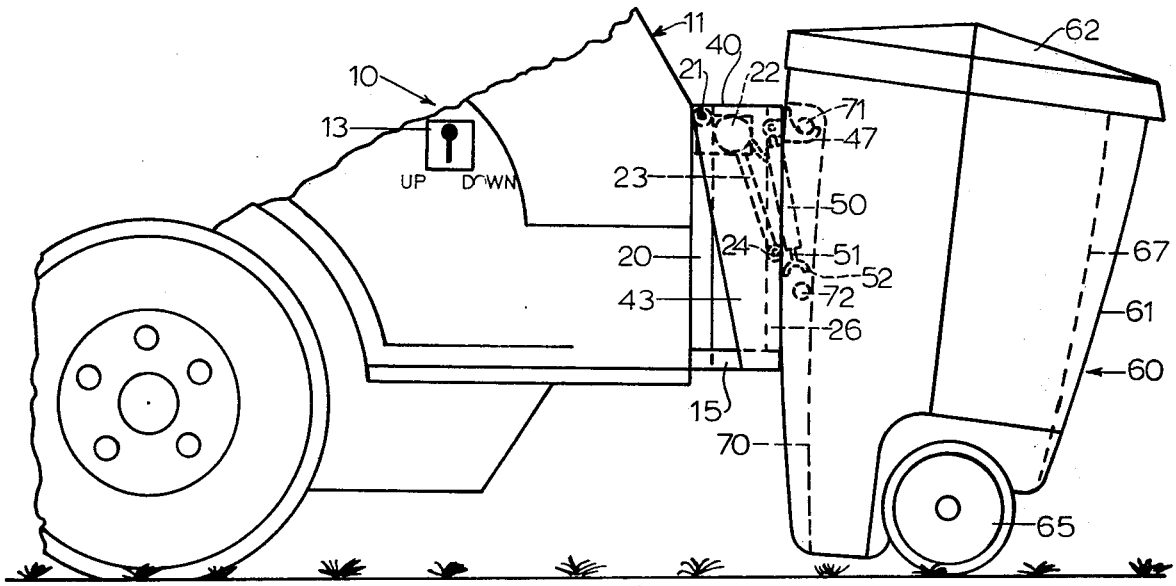
FIG. 1 is a side view of the invention in the initial lift position showing the refuse container immediately after the upper bar has been placed in the fixed upper support hook and preparatory to the rotation of the frame.
Figure 2:
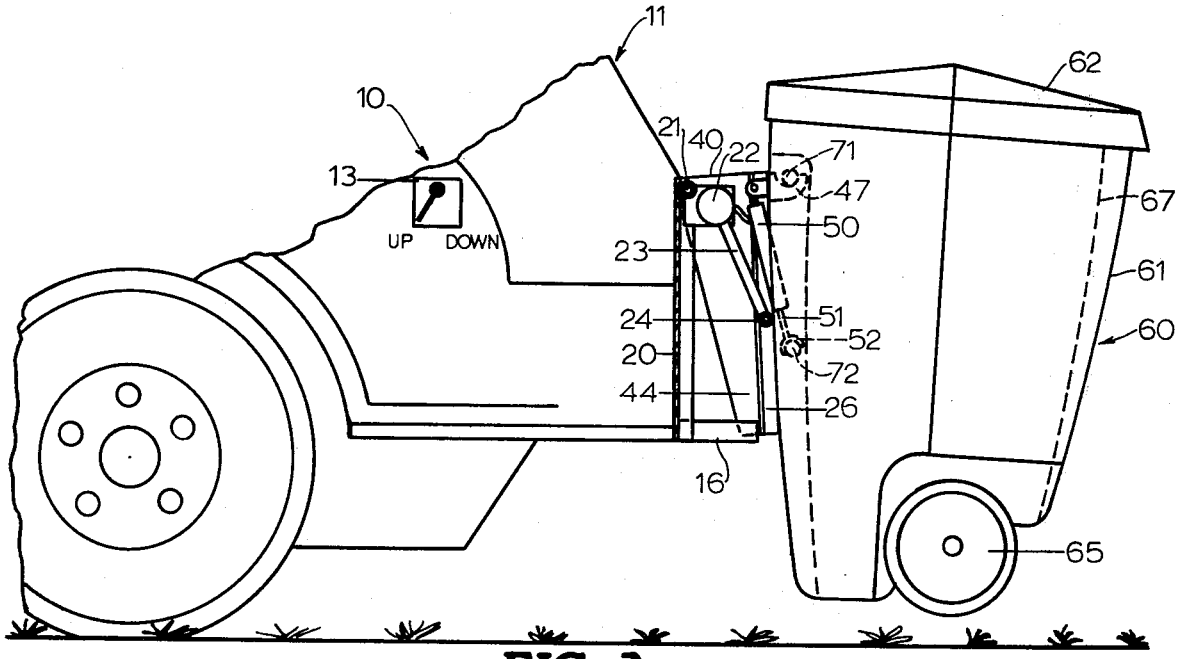
FIG. 2 is a view similar to FIG. 1 and showing the piston-mounted lower support hook immediately after it has moved into engagement with the lower cross bar of the waste container and with the lift platform side member removed for purposes of illustration.
Figure 3:
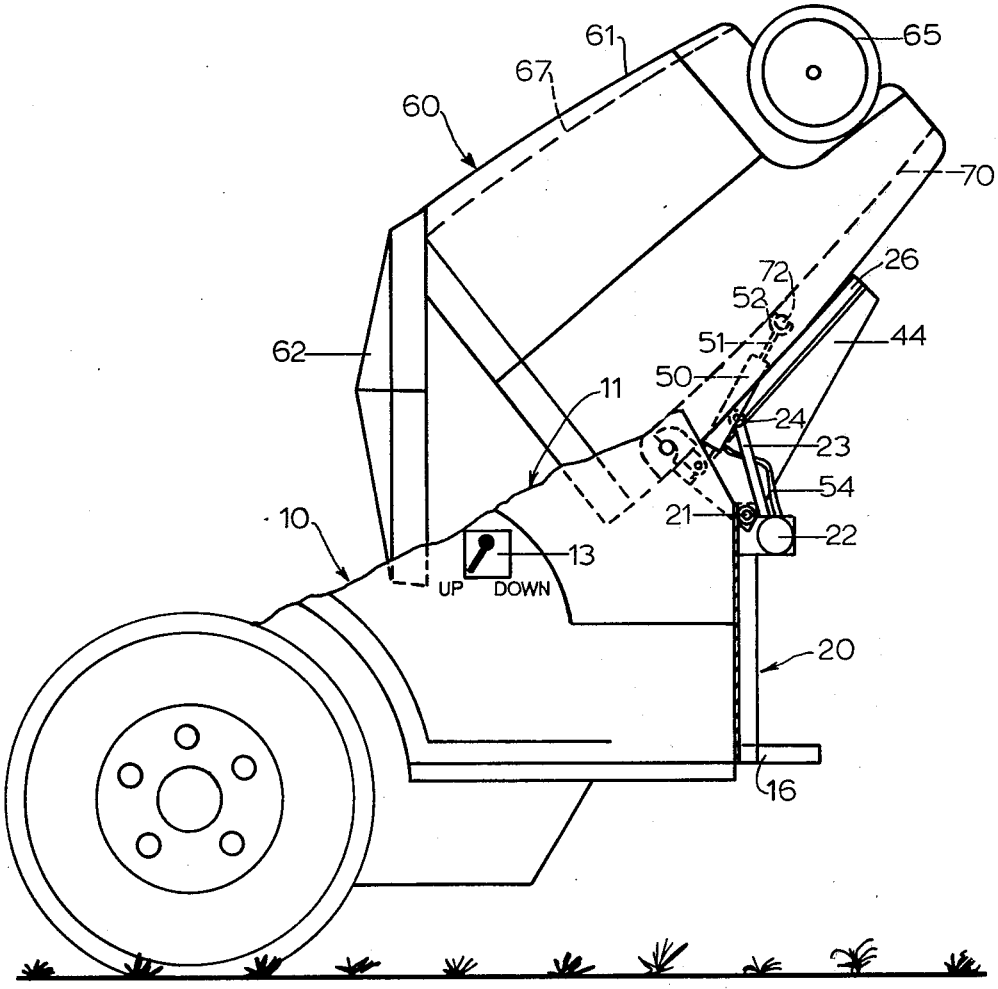
FIG. 3 is a view similar to FIGS. 1 and 2 and illustrating the refuse container in the fully inverted dumping position.

Referring to FIGS. 1 through 3, the dumping mechanism of the invention is shown attached to the rear portion of a conventional garbage truck 10 having a refuse-receiving opening 11. Fixedly secured to the truck body is a vertical support frame 20 which pivotally mounts a rotatable lift platform 40 about a main pivot shaft 21. The upper portion of frame 20 mounts a reversible hydraulic orbit motor 22 the direction of which is controlled by a two-way manual switch 13 on the side of truck 10. The hydraulic power to motor 22 is, in the preferred embodiment, supplied by the hydraulic system of the truck or in the alternative may be supplied by a self-contained hydraulic power pack. The motor may, also constitute a reversible electric motor. Motor 22 serves to rotate an elongated lift arm 23 having a roller 24 at its outer extremity. Roller 24 is adapted to ride in a channel track 26 on the opposing surface of platform 40 for pivoting of the platform about pivot shaft 21. Platform 40 is adapted to pivot from an initial lift position in which a pair of stop members 15, 16 abut platform 40 as seen in FIG. 1 to a fully pivoted dumping position as seen in FIG. 3. Various hydraulic lines, fittings and like details are not shown.

Figure 4:
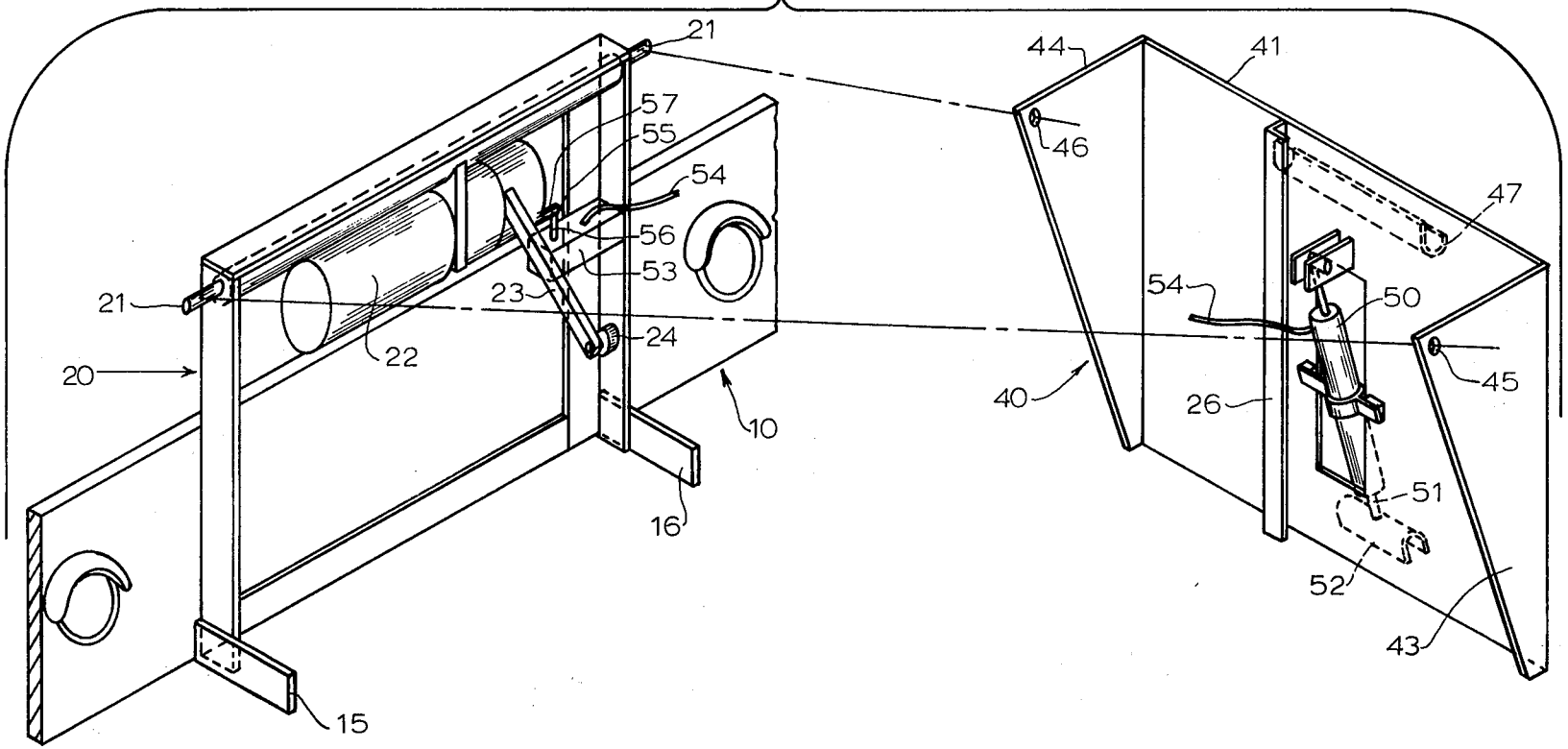
FIG. 4 is an exploded perspective view of the support frame and the rotatable lift platform.

Lift platform 40 (see FIG. 4) includes a main plate 41 and a pair of side members 43, 44 which are secured to plate 41. Side members 43, 44 have a pair of apertures 45, 46 for mounting on pivot shaft 21. The upper outwardly disposed portion of plate 41 mounts a fixed upper support hook 47 which is adapted to engage and support the upper locking bar 71 of refuse container 60. Mounted approximately in the middle of plate 41 is a spring-loaded, single-acting hydraulic cylinder 50. Cylinder 50 has a piston rod 51 on which is mounted a lower support hook 52 which is adapted to timely engage the lower locking bar 72 of refuse container 60. The piston-cylinder 50 has an approximate two-inch stroke, and when not energized the piston is held in a normally retracted position by its self-contained spring. Alternatively, a cylinder without a self-contained spring may be used and provided with an appropriately mounted external spring for returning it to the retracted position when not energized or a suitable double acting cylinder may be used.

In the specific embodiment, cylinder 50 is operated by connecting it to the hydraulic system of truck 10 through a directional control valve 53 and a hydraulic line 54. In the alternative, cylinder 50 may be operated by a self-contained hydraulic power pack mounted on the truck proximate the lifting device. In the specific embodiment valve 53 is opened and closed by a cam 55 and cam follower 56 arrangement illustrated in FIG. 4. Cam 55 is rotatably driven by the drive shaft of motor 22 as platform 40 pivots. When the system is in the initial lift position as in FIG. 1, the cam follower 57 rests in a recess 56 on cam 55 so that valve 53 is closed and cylinder 50 de-energized. As cam 55 rotates during the lifting operation to the position shown in FIG. 2, the cam follower 56 is moved out of the recess 57 and rests on the cylindrical surface of cam 55 so that valve 53 opens. Cam follower 57 remains in the cylindrical surface and valve 53 remains open to energize cylinder 50 so long as the container is lifted above the position shown in FIG. 2. As the container is lowered after dumping the cam follower 56 moves back into recess 57 and valve 53 closes to de-energize cylinder 50 and thereby move lower hook 52 out of engagement with lower bar 72. In the preferred embodiment the locking and unlocking of bar 72 (FIG. 2) takes place with wheels 65, 66 approximately 3 inches off the ground, with 1 inch to 18 inches being a range.

In operation, container 60 is rolled to the rear of truck 10 and upper locking bar 71 is placed into fixed upper support hook 47. The system at this point is in the initial lift position illustrated in FIG. 1. The operator next moves the control switch 13 located on the truck to the "up" position so as to energize orbit motor 22 which causes roller 24 to move in track 26 and platform 40 to start rotating. When the wheels are slightly off the ground cam follower 56 moves out the recess 57 and cylinder 50 is automatically energized through control valve 53. The energization of cylinder 50 causes the piston mounted lower support hook 52 to move into firm and positive engagement with lower locking bar 72 thereby locking container 60 to platform 40 (FIG. 2). Roller 24 continues to rise along track 26 until container 60 is elevated to the fully inverted dumping position shown in FIG. 3. Hydraulic pressure can remain applied without damage to the system while the refuse is actually being dumped. Hydraulic cylinders as well as electric drive motors suited to activate stalled conditions are well known and are readily adapted to the invention. The direction of orbit motor 22 is next reversed by switch 13 to return the platform 40 to the initial lift position wherein lower support hook 52 will have been disengaged from lower locking bar 72 by the action of the cam and cam follower arrangement as previously explained. Upper locking bar 71 may now be lifted from upper support hook 47 and the empty container 60 may be rolled away from truck 10.

It should be noted that piston-mounted lower support hook 52 is designed to be in engagement with lower bar 72 only when wheels 65, 66 are lifted from the ground. This delayed engagement has the advantage of preventing excessive stress on the container which could result if the piston were actuated with the container wheels still on the ground.

In summary, it can be seen that the present invention provides a system whereby the trash container can be quickly located on the lift mechanism, can be positively locked and secured during the lifting operation and can be as easily removed after the dumping operation and without damage or undue stress of the container in any of such operations. Other advantages arise by reason of eliminating the need for or employment of a pivotal hook on the lift mechanism as with certain of the prior art previously identified and discussed. By eliminating such pivotal hook on the lift mechanism the invention also eliminates the lift arm mounted camming linkages employed in certain of the previously described art. The employment of the lift mounted piston-cylinder locking arrangement of the invention nevertheless allows positive securement of the container to the lift mechanism to be responsive to initial lifting of the container and well prior to positioning of the container at its dumping position.

Thus, in summary it is believed that the present invention will be recognized as having many readily discernible advantages over the prior art both in terms of construction as well as in terms of maintenance, dependability and wear and tear on the container and lift mechanism.

What is claimed is:

1. A system for containing in a portable waste container municipal refuse, and the like, and dumping the container contents into a refuse receptacle having an opening in a wall portion thereof, comprising in combination:

a. a portable container having upper and lower vertically-spaced horizontal locking bars on a selected side surface thereof;

b. a dumping mechanism on said refuse receptacle adjacent said opening and comprising:

i. a support frame secured to said receptacle and mounting reversible motor means and an elongated lift arm, said motor means being arranged to pivot said lift arm about a fixed horizontal axis extending through an inner end thereof adjacent said frame, said lift arm having track traveler means at an opposite outer end portion thereof adapted for riding in a cooperative track;

ii. a lift platform having a plate member providing an outer surface for engaging a portion of said selected side surface of said container and having an upper portion thereof pivotally secured to said frame for pivoting on said frame about a fixed horizontal axis, said platform plate member having track means on an inner surface thereof facing said frame for receiving said lift arm track traveler means enabling said platform plate member to be pivoted on said frame in correspondence with pivoting of said lift arm by said motor means;

iii. a fixed upper hook member secured to said outer surface of said platform plate member and adapted for engaging said container upper bar and supporting said container thereon;

iv. a fluid actuated piston-cylinder unit having a housing portion fixedly secured to the inner surface of said platform plate member and having a linearly movable piston rod associated therewith, said piston rod being downwardly angled and mounting on its outer extremity a lower hook member oriented to engage said container lower bar at selected times dependent upon actuation of said piston-cylinder unit; and v. actuator means fixed to said frame and connected to an appropriate fluid source for said piston-cylinder unit and including control means governed by operation of said motor means, said motor means including a driven cam member and said actuator means including a cam follower member actuated by said cam member to control operation of said actuator means and thereby control actuation of said piston-cylinder unit in accordance with the positioning of said cam member, said actuator means being adapted to connect said fluid source to actuate said piston-cylinder unit in such manner that said piston-cylinder actuated lower hook is caused to positively and continuously engage said container lower bar and thereby rigidly secure said container to said platform at all times when the base of said container resides some predetermined distance above the ground and during which said container is being positioned between selected ground loading and elevated tilted dumping positions.

2. The system of claim 1 wherein said container mounts ground engaging support wheels, said wheels provide a support base for said container and said distance constitutes a distance measured by the bottom surfaces of said wheels being in the range of 1 to 18 inches above ground whenever said cylinder-piston unit is actuated.

3. The system as claimed in claim 1 wherein said motor means comprises an hydraulic orbit motor means.

4. The system of claim 1 wherein said piston-cylinder unit is of a type adapted to have the rod extended by fluid actuation and retracted by spring activation and including spring means to retract the rod.

5. The system of claim 1 wherein said predetermined distance is in the range of one to eighteen inches.

6. A system for municipal refuse, comprising in combination:

a. a portable waste container having upper and lower locking bars on a selected side surface thereof;

b. a dumping apparatus adapted for being secured to a waste collector having a wall opening proximate a refuse container;

said dumping apparatus comprising:

i. a rotatable frame pivoted on said waste collector;

ii. an upper hook member secured to said frame and adapted to engage said upper locking bar to receive and support said container when at a ground loading position;

iii. a fluid actuated piston-cylinder unit mounted on said frame and having a lower hook member mounted on a piston rod thereof and being adapted when said piston-cylinder unit is actuated and said container is being supported above ground by said upper locking bar to engage said lower locking bar whereby to positively secure said container to said frame during the pivoting thereof;

iv. reversible motor means secured to said waste collector and having associated pivotal arm means engaging track means on said frame enabling said frame to be rotated to bring said container to a dumping position and after dumping to be rotated back to said ground loading position;

v. manual motor control means mounted on said waste collector and enabling said motor means to be appropriately energized for selectively moving said frame to said dumping and ground loading positions; and vi. fluid control means mounted on said waste collector and adapted to pressurize said piston-cylinder unit in response to rotation of said frame whereby said lower hook member is caused to positively engage said lower locking bar at some predetermined angular raised position of said container on each occurrence of said frame being rotated from said ground loading towards said dumping position.

7. The system of claim 1 wherein said fluid control means includes a cam follower and said motor means includes camming means for operating said cam follower and the relative positions of said follower and camming means control said piston-cylinder unit pressurization to control engagement of said lower hook with said lower locking bar.

8. In a municipal refuse handling system, a dumping mechanism for lifting and dumping a portable waste container of the type having upper and lower locking means on a selected side surface thereof, said dumping mechanism comprising a frame rotatably mounted on a waste collector for rotation about a substantially horizontal axis, an upper hook member on said frame, a fluid actuated piston-cylinder unit mounted on said frame and having a lower, downwardly facing hook member mounted on the piston rod thereof, means to rotate said frame about such horizontal axis to lift and tilt a waste container supported thereon by said upper hook member and actuating means for automatically actuating said piston-cylinder unit at all times when said frame is lifted and tilted by at least some predetermined angular amount to positively engage said lower hook member with the lower locking means on said waste container. said means to rotate said frame including a driven cam member and said actuating means including a cam follower member actuated by said cam member to control operation of said actuating means and thereby control actuation of said piston-cylinder unit in accordance with the positioning of said cam member.

* * * * *

UNITED STATES PATENT OFFICE

CERTIFICATE OF CORRECTION

Patent No. 4,042,137 Dated August 16, 1977

Inventor(s) Thomas Philip Hughes and Clark Alexander Sherrill

It is certified that error appears in the above-identified patent and that said Letters Patent are hereby corrected as shown below:

Col. 2, line 66, Delete the comma after the word "may".

Col. 3, line 44, "follower 57" should read --follower 56--.

Col. 3, line 44, "in" should read --on--.

Col. 6, line 61, The period should be a comma.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*

UNITED STATES PATENT OFFICE

CERTIFICATE OF CORRECTION

Patent No. 4,042,137 Dated August 16, 1977

Inventor(s) Thomas Philip Hughes and Clark Alexander Sherrill

It is certified that error appears in the above-identified patent and that said Letters Patent are hereby corrected as shown below:

Col. 3, line 38, "follower 57" should read --follower 56--.

Col. 3, line 39, "recess 56" should read --recess 57--.

Signed and Sealed this

Second Day of May 1978

[SEAL]

Attest:

RUTH C. MASON
Attesting Officer

LUTRELLE F. PARKER
Acting Commissioner of Patents and Trademarks